US010280056B1

(12) United States Patent
Davis

(10) Patent No.: US 10,280,056 B1
(45) Date of Patent: May 7, 2019

(54) LOAD CLAMPING WEAR-PLATE SYSTEMS

(71) Applicant: Steven R. Davis, Glen Ellyn, IL (US)

(72) Inventor: Steven R. Davis, Glen Ellyn, IL (US)

( * ) Notice: Subject to any disclaimer, the term of this patent is extended or adjusted under 35 U.S.C. 154(b) by 0 days.

(21) Appl. No.: 15/279,238

(22) Filed: Sep. 28, 2016

Related U.S. Application Data

(60) Provisional application No. 62/233,970, filed on Sep. 28, 2015, provisional application No. 62/277,402, filed on Jan. 11, 2016.

(51) Int. Cl.
*B66F 9/18* (2006.01)
*B66F 13/00* (2006.01)

(52) U.S. Cl.
CPC ..... *B66F 9/183* (2013.01); *B66F 13/00* (2013.01)

(58) Field of Classification Search
CPC ..... B66F 9/183
USPC ..... 294/119.1, 902; 414/621
See application file for complete search history.

(56) References Cited

U.S. PATENT DOCUMENTS 2,671,571 A * 3/1954 Gerhardt ..... B66F 9/183 294/207
2,690,271 A * 9/1954 Marietta ..... B66F 9/184 414/623
2,782,066 A * 2/1957 Lord ..... B66F 9/183 294/119.1
2,874,862 A * 2/1959 Farmer ..... B66F 9/184 294/197
3,370,880 A * 2/1968 Carliss ..... B66F 9/183 294/119.1
3,433,376 A * 3/1969 Jordan ..... B66F 9/183 294/207
3,643,827 A * 2/1972 Link ..... B66F 9/183 294/104
3,971,584 A * 7/1976 Duncan ..... B66F 9/183 294/119.1
3,971,585 A * 7/1976 LaBudde ..... B66F 9/183 294/119.1
3,990,594 A * 11/1976 Olson ..... B66F 9/183 294/207
4,266,819 A * 5/1981 Pemberton ..... B66F 9/18 294/104
4,290,729 A * 9/1981 Cary ..... B66F 9/12 414/607
4,747,610 A * 5/1988 Yingling ..... B62B 3/0612 180/271
4,755,096 A * 7/1988 Leeper ..... A23G 7/0037 198/468.2
5,209,536 A * 5/1993 Rogers, Sr. ..... B66C 1/427 294/104
5,221,176 A * 6/1993 Allen ..... B66F 9/12 414/607
5,456,565 A * 10/1995 Pigott ..... B66F 9/12 187/222
5,897,286 A * 4/1999 Whittaker ..... B66F 9/12 187/237
7,118,148 B1 10/2006 Davis
(Continued)

*Primary Examiner* — Paul T Chin
(74) *Attorney, Agent, or Firm* — Lodestar Patents, PLLC; Raymond J. E. Hall

(57) ABSTRACT

This invention relates to providing a system for improved wear protection for the lift plates of industrial lift trucks. More particularly this invention relates to providing a system for providing increased wear protection on replaceable lift-blade attachments for industrial forklifts and similar load-lifting trucks.

21 Claims, 4 Drawing Sheets

(56) References Cited

U.S. PATENT DOCUMENTS

| | | | | |
|---|---|---|---|---|
| 7,571,942 | B2 * | 8/2009 | Shapiro | E01H 5/061 293/38 |
| 8,016,334 | B2 * | 9/2011 | Garrett | A01D 87/122 294/119.1 |
| D796,149 | S * | 8/2017 | Takaguchi | D34/35 |

* cited by examiner

LOAD CLAMPING WEAR-PLATE SYSTEMS

CROSS-REFERENCE TO RELATED APPLICATION

The present application is related to and claims priority from prior provisional application Ser. No. 62/233,970, filed Sep. 28, 2015, entitled "LOAD CLAMPING WEAR-PLATE SYSTEMS"; and, this application is related to and claims priority from prior provisional application Ser. No. 62/277,402, filed Jan. 11, 2016, entitled "LOAD CLAMPING WEAR-PLATE SYSTEMS", the contents of all of which are incorporated herein by this reference and are not admitted to be prior art with respect to the present invention by the mention in this cross-reference section.

BACKGROUND

This invention relates to providing a system for improved wear protection for the lift plates of industrial lift trucks. More particularly this invention relates to providing a system for providing increased wear protection on replaceable lift-blade attachments for industrial forklifts and similar load-lifting trucks. Industrial forklifts commonly employ a set of lift plates used to move and/or lift heavy materials in industrial settings. Such apparatus are used in a variety of manufacturing, receiving, warehousing and shipping environments that require clamp handling.

In typical operation, lift plates move together to engage, lift, and transport the load. When the load is transported to the selected location, the lift plates are moved away from one another to release the load. During such use, the lift plates are often subjected to abrasive wear. If a significant wear of the lift plates occurs, slippage of a load which is squeezed between the plates frequently takes place which is potentially dangerous. Further, abrasive wear also occurs on the lower edge of the lift plates from contact with the floor. Additionally, in the past it was necessary to replace the entire clamping assembly, which can be very expensive, when such abrasive wear occurs.

OBJECTS AND FEATURES OF THE INVENTION

A primary object and feature of the present invention is to provide an improved wear protection system addressing the above-mentioned problem.

It is a further object and feature of the present invention to provide such a wear protection system that effectively extends the service life of the clamping plates of an industrial-type lift truck.

It is another object and feature of the present invention to provide such a wear protection system comprising a replaceable wear bar on the lower edge of replaceable auxiliary clamping plates of industrial-type lift trucks.

A further primary object and feature of the present invention is to provide such a system that is efficient, inexpensive, and useful. Other objects and features of this invention will become apparent with reference to the following descriptions.

SUMMARY OF THE INVENTION

In accordance with a preferred embodiment hereof, this invention provides a wear protection system related to extending the service life of at least one clamping plate of at least one industrial-type lift truck, such system comprising:

at least one wear-resistant protector structured and arranged to protect at least one face-portion and at least one edge-portion, while in operation of moving at least one load, of the at least one clamping plate of the at least one industrial-type lift truck; wherein such at least one wear-resistant protector comprises at least one first longitudinal edge, at least one second longitudinal edge, and at least one forward edge extending therebetween, at least one removable retainer structured and arranged to removably retain such at least one wear-resistant protector in at least one operable position adjacent such at least one clamping plate, positioned along substantially the entire at least one forward edge, at least one replaceable wear member structured and arranged to protect substantially the entire such at least one forward edge from abrasive wear, and positioned along substantially the entire at least one first longitudinal edge, at least one wear-guard structured and arranged to guard substantially the entire such at least one first longitudinal edge and the at least one edge-portion against abrasive wear; wherein such at least one replaceable wear member comprises at least one removable fastener structured and arranged to removably fasten such at least one replaceable wear member to such at least one wear-resistant protector; and wherein such at least one wear-guard substantially covers the at least one edge-portion of the at least one clamping plate.

Moreover, it provides such a wear protection system wherein such at least one wear-guard comprises at least one bar underlying such at least one edge-portion on the lower edge of the at least one clamping plate.

Additionally, it provides such a wear protection system wherein: such at least one wear-resistant protector further comprises at least one contact plate structured and arranged to contact at least one portion of at least one load during transport by the at least one industrial-type lift truck; wherein such at least one contact plate extends substantially between such at least one first longitudinal edge, such at least one second longitudinal edge, such at least one forward edge, and at least one rear edge of such at least one wear-resistant protector; and wherein the at least one operable position of such at least one wear-resistant protector places such at least one contact plate in a position substantially between the at least one clamping plate and the at least one load.

Also, it provides such a wear protection system wherein such at least one contact plate comprises at least one friction augmenter structured and arranged to augment the frictional forces developed during contact with the at least one load. In addition, it provides such a wear protection system wherein such at least one friction augmenter comprises at least one resilient compressible material. And, it provides such a wear protection system wherein: such at least one resilient compressible material comprises at least one rubber-like material; and such at least one resilient compressible material covers substantially the entire such at least one contact plate. Further, it provides such a wear protection system wherein such at least one resilient compressible material is bonded to such at least one contact plate. Even further, it provides such a wear protection system wherein such at least one resilient compressible material comprises a plurality of substantially parallel surface grooves.

Moreover, it provides such a wear protection system wherein such at least one contact plate substantially comprises at least one metallic composition. Additionally, it provides such a wear protection system wherein such at least one contact plate substantially comprises aluminum.

Also, it provides such a wear protection system wherein such at least one replaceable wear member substantially comprises at least one metallic composition. In addition, it provides such a wear protection system wherein such at least one replaceable wear member comprises substantially steel.

And, it provides such a wear protection system wherein such at least one removeable retainer comprises at least one plurality of threaded fasteners structured and arranged to mechanically engage the at least one clamping plate. Further, it provides such a wear protection system wherein such at least one threaded fastener is structured and arranged to mechanically engage at least one pre-existing recessed hole in the at least one clamping plate. Even further, it provides such a wear protection system wherein such plurality of fasteners comprise countersunk bolts having exposed heads thereof structured and arranged to be situated below the respective exposed surfaces of such at least one contact plate and such at least one replaceable wear member.

In accordance with another preferred embodiment hereof, this invention provides a wear protection system related to extending the service life of at least one clamping plate of at least one industrial-type lift truck, such system comprising: wear-resistant protector means for protecting at least one face-portion and at least one edge-portion, while in operation of moving at least one load, of the at least one clamping plate of the at least one industrial-type lift truck; wherein such wear-resistant protector means comprises at least one first longitudinal edge, at least one second longitudinal edge, and at least one forward edge extending therebetween, removable retainer means for removably retaining such wear-resistant protector means in at least one operable position adjacent such at least one clamping plate, positioned along substantially the entire at least one forward edge, replaceable wear member means for protecting substantially the entire such at least one forward edge from abrasive wear, and positioned along substantially the entire at least one first longitudinal edge, wear-guard means for protecting substantially the entire such at least one first longitudinal edge and the at least one edge-portion from abrasive wear; wherein such replaceable wear member means comprises removable fastener means for removably fastening such replaceable wear member means to such wear-resistant protector means; and wherein such at least one replaceable wear-bar means substantially covers the at least one edge-portion of the at least one clamping plate.

Moreover, it provides such a wear protection system wherein: such wear-resistant protector means further comprises contact means for contacting at least one portion of at least one load during transport by the at least one industrial-type lift truck; wherein such contact means extends substantially between such at least one first longitudinal edge, such at least one second longitudinal edge, such at least one forward edge, and at least one rear edge of such wear-resistant protector means; and wherein the at least one operable position of such wear-resistant protector means places such contact means in a position substantially between the at least one clamping plate and the at least one load.

Additionally, it provides such a wear protection system wherein such contact means comprises friction augmenter means for augmenting the frictional forces developed during contact with the at least one load. Also, it provides such a wear protection system wherein such friction augmenter means comprises at least one resilient compressible material. In addition, it provides such a wear protection system wherein such at least one resilient compressible material covers substantially the entire such contact means.

In accordance with another preferred embodiment hereof, this invention provides a wear protection system related to extending the service life of at least one clamping plate of at least one industrial-type lift truck, such system comprising: at least one wear-resistant protector structured and arranged to protect at least one face-portion and at least one edge-portion, while in operation of moving at least one load, of the at least one clamping plate of the at least one industrial-type lift truck; wherein such at least one wear-resistant protector comprises at least one contact plate structured and arranged to contact at least one portion of at least one load during transport by the at least one industrial-type lift truck, wherein such at least one contact plate comprises at least one friction augmenter structured and arranged to augment the frictional forces developed during contact with the at least one load, at least one removable retainer structured and arranged to removably retain such at least one wear-resistant protector in at least one operable position adjacent the at least one clamping plate, positioned along substantially the entire at least one forward edge of such at least one contact plate, at least one replaceable shoe structured and arranged to protect substantially the entire such at least one forward edge from abrasive wear, and positioned along substantially the entire lower edge of such at least one contact plate, at least one wear-guard bar structured and arranged to guard substantially the entire such lower edge against abrasive wear; and wherein such at least one replaceable shoe comprises at least one removable fastener structured and arranged to removably fasten such at least one replaceable shoe to the at least one clamping plate; wherein such at least one wear-guard bar substantially covers the at least one edge-portion of the at least one clamping plate; wherein such at least one contact plate and such at least one replaceable shoe together extend the width of the lower portion of the at least one clamping plate; and wherein such at least one contact plate and such at least one replaceable shoe together substantially covers the at least one face-portion of the at least one clamping plate. Each and every novel feature, element, combination, step and/or method disclosed or suggested by this patent application.

DETAILED DESCRIPTION OF THE BEST MODES AND PREFERRED EMBODIMENTS OF THE INVENTION

A lift truck is designed with load clamping plates which move toward and away from each other. In typical operation, clamping plates move together to engage, lift, and transport the load. When the load is transported to the selected location, the clamping plates are moved away from one another to release the load. During such use, the clamping plates are often subjected to abrasive wear on the plate surfaces. If a significant wear of the lift plates occurs, slippage of a load, which is squeezed between the plates, frequently takes place which is potentially dangerous.

Additionally, in the past it was necessary to replace the entire clamping assembly, which can be very expensive. Furthermore, additional wear can occur on the lower edge of the clamping plates as a result of the clamping plates being dragged or scraped on a surface as the load is being moved. This will also cause a necessity to replace the lift plates frequently, which can also be costly.

Figure 1:
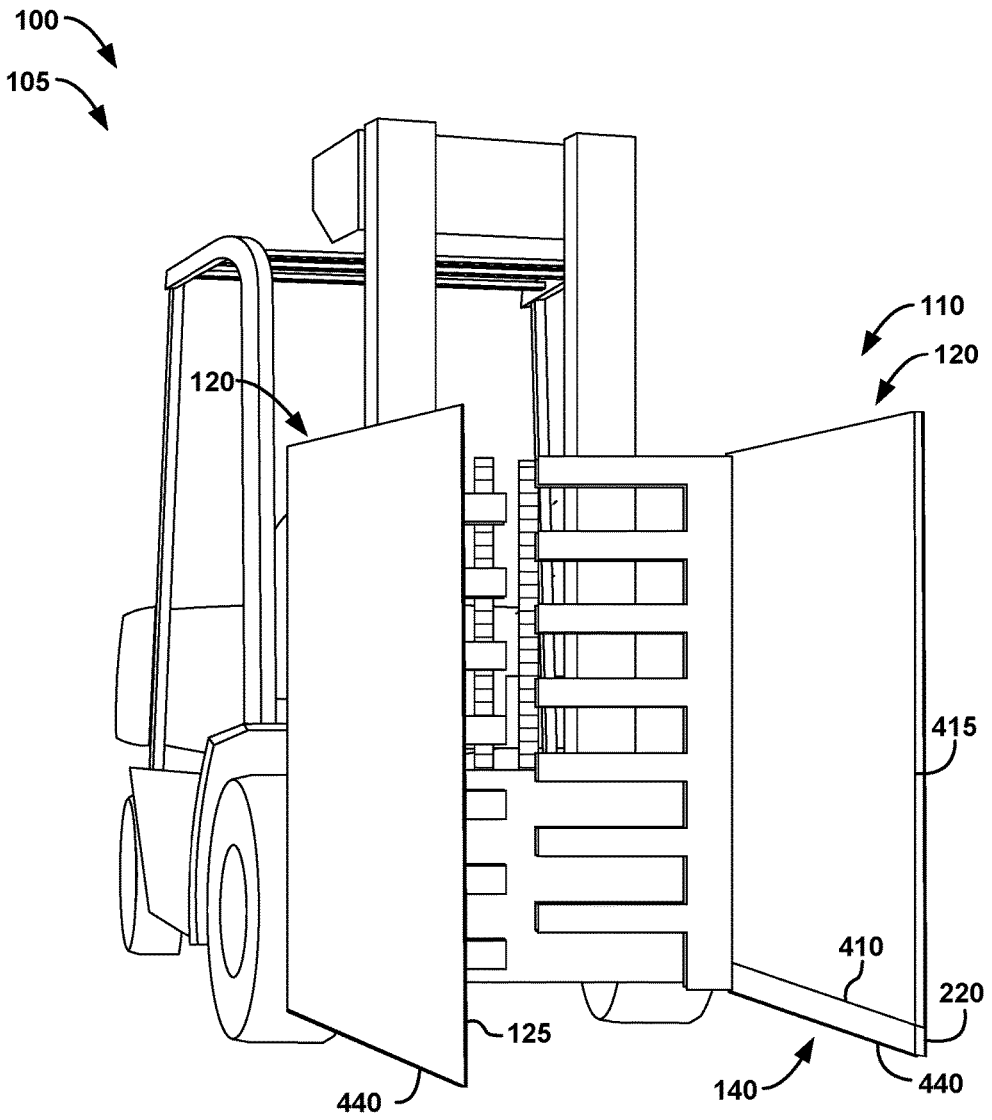
FIG. 1 shows a perspective view, illustrating a set of replaceable load clamping plates of load clamping plate-wear system in an operable position on a lift truck, according to a preferred embodiment of the present invention.

FIG. 1 shows a perspective view, illustrating a set of replaceable load clamping-plate assemblies 120 of load clamping plate-wear system 100 in an operable position on a lift truck 105, as shown. Clamping-plate assembly 120 is depicted mounted in a preferred operable position on a lift truck 105, according to a preferred embodiment of the present invention.

As illustrated generally in FIG. 1, a preferred embodiment of load clamping plate-wear system 100 is shown, as preferably used in conjunction with an industrial-type lift truck 105. The industrial-type lift truck 105 preferably comprises at least two clamping-plate assemblies 120, preferably at least one on the right and one on the left, preferably mirror images of each other. Lift truck 105 is designed to move clamping-plate assemblies 120 on a clamping mechanism, laterally toward and away from one another, and vertically on an additional mechanism, as shown in FIG. 1.

The details of operating the assembly shown in FIG. 1 to effect the movement of the mechanisms are not provided here, since one of ordinary skill in the art, upon reading this specification, will appreciate how the present embodiments may be used in conjunction with such apparatus.

In operation, clamping-plate assembly 120 is moved adjacent the opposite sides of a large piece of equipment; such as a stack of large boxes or other similar load, and then are moved toward one another to squeeze the load thereby allowing the load to be lifted. The load may then be transported to a selected location. The load is then either raised or lowered to a selected position, and finally, clamping-plate assemblies 120 are moved away from one another laterally to allow the load to be placed in the selected location.

Clamping-plate assembly 120 preferably comprises clamping plate 125 and at least one clamping pad 415, as shown. Clamping plate 125 preferably comprises metallic material, preferably aluminum (aluminum is a relatively light metallic material, allowing for easier handling). Clamping pad 415 preferably comprises a friction material structured and arranged to frictionally hold the load when clamping plate 125 engages the load. Clamping pad 415 preferably yields slightly under pressure to prevent damage to the load and clamping plate 125. Clamping pad 415 comprises preferably rubber, alternately preferably a rubber-like material. Clamping pad 415 preferably comprises raised portions, preferably separated by parallel grooves, preferably extending from front to back (see FIG. 4). Clamping pad 415 is preferably bonding attached to clamping plate 125, as shown. Clamping pad 415 preferably is on the inside of clamping plate 125 as shown, such that each clamping pad 415, on opposing clamping-plate assemblies 120, are facing each other to allow for augmentation of the frictional forces resulting from contact with the load during transportation. After a period of operation, clamping-plate assembly 120 typically requires maintenance due to normal operational wear. The rather large size and weight of clamping-plate assembly 120 increases the cost of such maintenance. This customarily involves extensive replacement of apparatus components, even when wear is localized in high-wear areas, such as, for example, the forward edges and lower regions of clamping-plate assembly 120.

Figure 2:
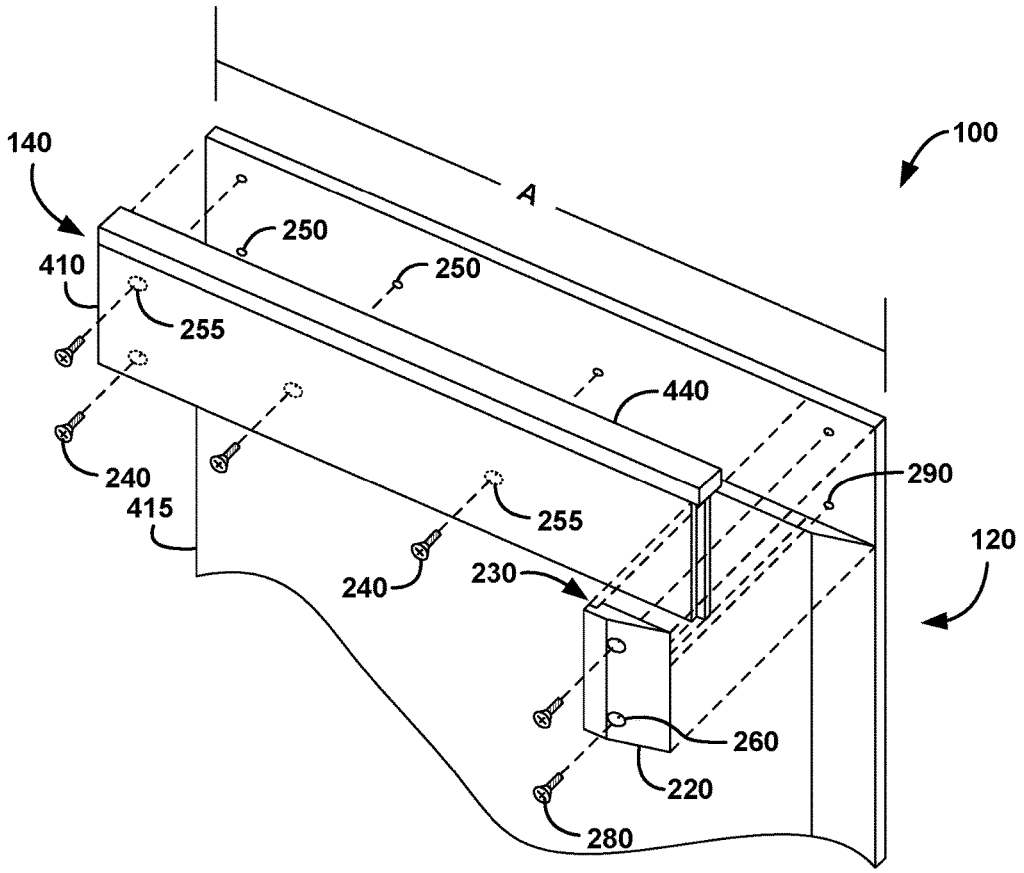
FIG. 2 shows an exploded bottom perspective view of load clamping plate-wear system according to a preferred embodiment of FIG. 1.
Figure 3A:
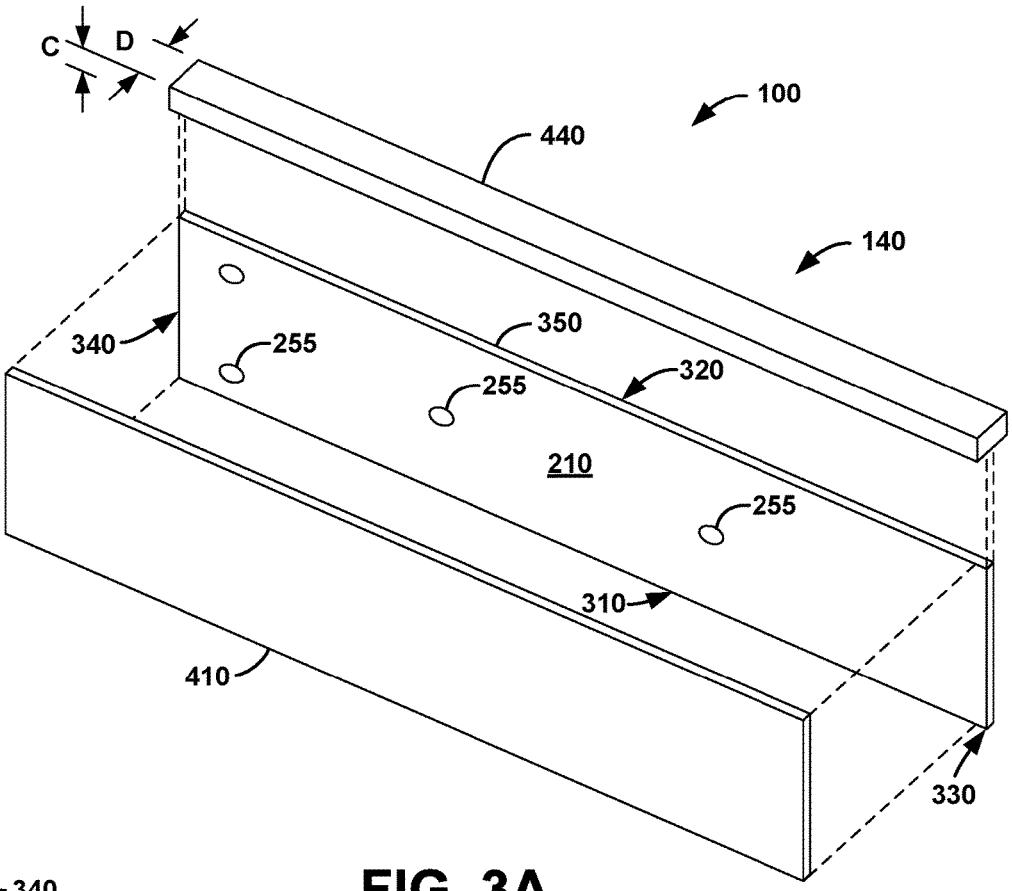
FIG. 3A shows an exploded bottom perspective view of the load clamping auxiliary wear-plate assembly of load clamping plate-wear system, according to a preferred embodiment of FIG. 2.
Figure 3B:
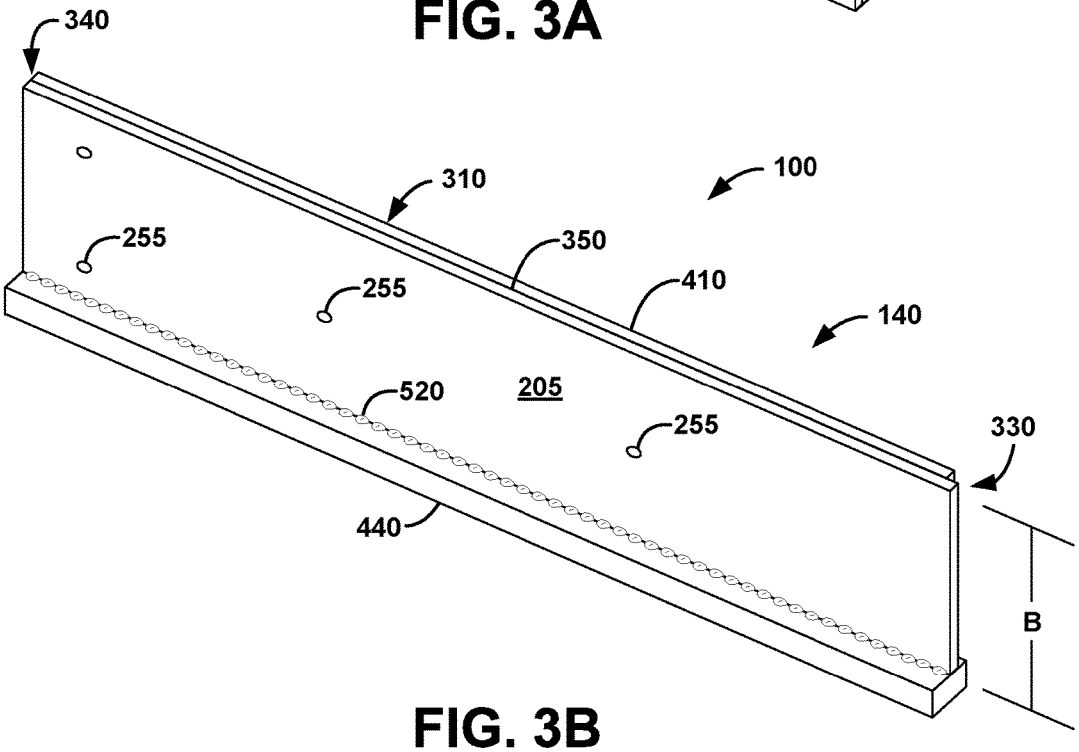
FIG. 3B shows a back perspective view of the replaceable load clamping-plate assembly of load clamping plate-wear system according to a preferred embodiment of FIG. 3A.

FIG. 2 shows an exploded bottom perspective view of load clamping plate-wear system 100 according to a preferred embodiment of FIG. 1. FIG. 3A shows an exploded bottom perspective view of the load clamping auxiliary wear-plate assembly 140 of load clamping plate-wear system 100, according to a preferred embodiment of FIG. 2. FIG. 3B shows a rear perspective view of the replaceable load clamping-plate assembly of load clamping plate-wear system according to a preferred embodiment of FIG. 3A.

The preferred embodiment of load clamping plate-wear system 100 is preferably configured to reduce or eliminate the need for full replacement of the load clamping plate-assembly 110 by preferably locating removable/replaceable wear surfaces at high-wear regions of apparatus. The at least one clamping-plate assembly 120 is preferably fitted with a load clamping auxiliary wear-plate assembly 140, as shown.

Clamping plate-wear system 100 preferably comprises at least two load clamping auxiliary wear-plate assemblies 140 (at least herein embodying at least one wear-resistant protector structured and arranged to protect at least one face-portion and at least one edge portion, while in operation of moving at least one load, of the at least one clamping plate of the at least one industrial-type lift truck; and at least herein embodying wear-resistant protector means for protecting at least one face-portion and at least one edge-portion, while in operation of moving at least one load, of the at least one clamping plate of the at least one industrial-type lift truck), preferably at least one on the right and one on the left, preferably mirror images of each other. Load clamping auxiliary wear-plate assembly 140 preferably comprises a generally rectangular plate-like shape having a width B of about 8 inches (see FIG. 3B). Load clamping auxiliary wear-plate assembly 140 preferably comprises first longitudinal edge 310, second longitudinal edge 320, and forward edge 330, as shown (at least herein embodying wherein said at least one wear-resistant protector comprises at least one first longitudinal edge, at least one second longitudinal edge and at least one forward edge extending therebetween; and at least herein embodying wherein said at least one wear-resistant protector means comprises at least one first longitudinal edge, at least one second longitudinal edge, and at least one forward edge extending therebetween; and at least herein embodying at least one wear-resistant protector structured and arranged to protect at least one face-portion and at least one edge-portion, while in operation of moving at least one load, of the at least one clamping plate of the at least one industrial-type lift truck extending therebetween), as shown. Preferably, first longitudinal edge 310 and second longitudinal edge 320 are substantially parallel and extend the full length of the assembly, as shown. Load clamping auxiliary wear-plate assembly 140 preferably comprises a substantially rigid contact plate 350 (at least herein embodying wherein said at least one wear-resistant protector further comprises at least one contact plate structured and arranged to contact at least one portion of at least one load during transport by the at least one industrial-type lift truck; and at least herein embodying wherein said wear-resistant protector means further comprises contact means for contacting at least one portion of at least one load during transport by the at least one industrial-type lift truck; and at least herein embodying at least one contact plate structured and arranged to contact at least one portion of at least one load during transport by the at least one industrial-type lift truck) preferably extending between first longitudinal edge 310, second longitudinal edge 320, forward edge 330 and rear edge 340 of load clamping auxiliary wear-plate assembly 140 (at least herein embodying wherein said at least one contact plate extends substantially between said at least one first longitudinal edge, said at least one second longitudinal edge, said at least one forward edge, and at least one rear edge of said at least one wear-resistant protector; and at least herein embodying wherein said contact means extends substantially between said at least one first longitudinal edge, said at least one second longitudinal edge, said at least one forward edge and at least one rear edge of said wear-resistant protector means), as shown. Contact plate 350 preferably comprises inner face 210 and back face 205 (best illustrated on FIGS. 3A and 3B). Contact plate 350 (at least herein embodying wherein said at least one contact plate substantially comprises at least one metallic composition; and at least herein embodying wherein said at least one contact plate substantially comprises aluminum) preferably comprises a metallic composition, preferably aluminum. Upon reading the teachings of this specification, those skilled in the art will now appreciate that, under appropriate circumstances, considering such issues as cost, user preference, new technology, etc., other materials, such as, for example, steel, abrasion-resistant (AR) steel, mild steel, other metals, plastics, etc., may suffice.

Load clamping auxiliary wear-plate assembly 140 preferably further comprises at least one auxiliary pad 410 (at least herein embodying wherein said at least one contact plate comprises at least one friction augmenter structured and arranged to augment the frictional forces developed during contact with the at least one load; and at least herein embodying wherein said at least one friction augmenter comprises at least one resilient compressible material; and at least herein embodying wherein contact means comprises friction augmenter means for augmenting the frictional forces developed during contact with the at least one load; and at least herein embodying wherein friction augmenter means comprises at least one resilient compressible material; and at least herein embodying wherein said at least one contact plate comprises at least one friction augmenter structured and arranged to augment the frictional forces developed during contact with the at least one load). Auxiliary pad 410 preferably is substantially similar in function and material to clamping pad 415, however is sized and positioned to fit on load clamping auxiliary wear-plate assembly 140, as shown. Auxiliary pad 410 (at least herein embodying wherein said at least one resilient compressible material comprises at least one rubber-like material; and at least herein embodying wherein said at least one resilient compressible material covers substantially the entire said at least one contact plate; and at least herein embodying wherein said at least one resilient compressible material covers substantially the entire said at least one contact means) comprises preferably rubber or alternately preferably a rubber-like material. Auxiliary pad 410 (at least herein embodying wherein said at least one resilient compressible material comprises a plurality of substantially parallel surface grooves) preferably comprises raised portions 420, preferably separated by parallel grooves 430, preferably extending from front to back similar to clamping pad 415, as illustrated most clearly in FIG. 4. Auxiliary pad 410 (at least herein embodying wherein said at least one resilient compressible material is bonded to said at least one contact plate) preferably is bonded to inner face 210 of contact plate 350 of the load clamping auxiliary wear-plate assembly 140.

Inner face 210 of contact plate 350 (at least herein embodying wherein the at least one operable position places said at least one wear-resistant protector places said at least one contact plate in a position substantially between the at least one clamping plate and the at least one load; and at least herein embodying wherein the at least one operable position of said wear-resistant protector means places said contact means in a position substantially between the at least one clamping plate and the at least one load) is preferably substantially planar and preferably functions, in combination with a facing of yieldable friction material 410, to engage the load during material handling operations.

Forward edge 330 of load clamping auxiliary wear-plate assembly 140 preferably comprises a replaceable shoe or nose piece 220 (at least embodying herein positioned along substantially the entire at least one forward edge, at least one replaceable wear member structured and arranged to protect substantially the entire said at least one forward edge from abrasive wear; and at least embodying herein positioned along substantially the entire at least one forward edge, replaceable wear member means for protecting substantially the entire said at least one forward edge from abrasive wear; and at least embodying herein positioned along substantially the entire at least one forward edge of said at least one contact plate, at least one replaceable shoe structured and arranged to protect substantially the entire said at least one forward edge from abrasive wear), preferably having a beveled front edge, as shown. Nose piece 220 is preferably positioned at inner face 210 along substantially the entire width of forward edge 330, as shown. More specifically nose piece 220 comprises a preferred width B substantially equaling the preferred width B of load clamping auxiliary wear-plate assembly 140, as shown.

Nose piece 220 preferably functions as a replaceable wear member structured and arranged to protect substantially the entire forward edge 330 from abrasive wear during use. Preferably, nose piece 220 (at least herein embodying wherein at least one replaceable wear member substantially comprises at least one metallic composition; and at least herein embodying wherein said at least one replaceable wear member comprises substantially steel) substantially comprises at least one metallic composition, more preferably steel, most preferably abrasion-resistant (AR) steel. Upon reading the this specification, those with ordinary skill in the art will now appreciate that, under appropriate circumstances, considering such issues as cost, intended use, etc., other material arrangements such as, for example, mild steel, other metals, cermets, high-density plastics, etc., may suffice.

As shown in FIG. 2, attachment of nose piece 220 is preferably effected through recessed holes 260 by means of threaded fasteners 280 (at least herein embodying wherein said at least one wear-resistant protector comprises at least one removable retainer structured and arranged to removably retain said at least one wear-resistant protector in at least one operable position adjacent said at least one clamping plate; and at least herein embodying wherein said wear-resistant protector means comprises removable retainer means in at least one operable position adjacent said at least one clamping plate; and at least embodying herein at least one removable retainer structured and arranged to removably retain said at least one wear resistant protector in at least one operable position adjacent the at least one clamping plate), which preferably engage tapped holes 290 (at least herein embodying wherein said at least one fastener is structured and arranged to mechanically engage at least one pre-existing recessed hole in the at least one clamping plate) (or recessed nuts secured into the exposed or outer surface of the respective load clamping auxiliary wear-plate assembly 140) to firmly hold nose piece 220 in place on the respective load clamping auxiliary wear-plate assembly 140, preferably adjacent forward edge 330 (at least herein embodying wherein said at least one removable retainer comprises at least one plurality of threaded fasteners structured and arranged to mechanically engage the at least one clamping plate), as shown. Threaded fasteners 280 (at least herein embodying wherein said at least one replaceable wear member comprises at least one removable fastener structured and arranged to removably fasten said at least one replaceable wear member to said at least one wear-resistant protector; and at least herein embodying wherein said replaceable wear member means comprises removable fastener means for removably fastening said replaceable wear member means to said wear-resistant protector means; and at least herein embodying wherein said at least one replaceable shoe comprises at least one removable fastener structured and arranged to removably fasten said at least one replaceable shoe to the at least one clamping plate) preferably comprise ¼-inch diameter by ½-inch long flat-head socket cap screws having 20 threads per inch (TPI).

It should be noted that threaded fasteners 280 (at least herein embodying wherein said plurality of fasteners comprise countersunk bolts having exposed heads thereof structured and arranged to be situated below the respective exposed surfaces of said at least one contact plate and said at least one replaceable wear member) passing through nose piece 220 preferably do not extend through the exposed surface of load clamping auxiliary wear-plate assembly 140 and the heads of threaded fasteners 280 are preferably maintained below the exposed surface of nose piece 220 in recessed holes 260, as shown. It should also be noted that the nose piece 220 is tapered from the front edge outwardly to the upper surface, as shown. The manner in which nose piece 220 fits over forward edge 330 of the load clamping auxiliary wear-plate assembly 140 is by means of a recess 230 having a thickness equal to the thickness of contact plate 350.

Load clamping auxiliary wear-plate assembly 140 with nose piece 220 attached preferably comprises a total length A which is substantially equal to length A of clamping-plate assemblies 120 (at least herein embodying wherein said at least one contact plate and said at least one replaceable shoe together extend the width of the lower portion of the at least one clamping plate).

Figure 4:
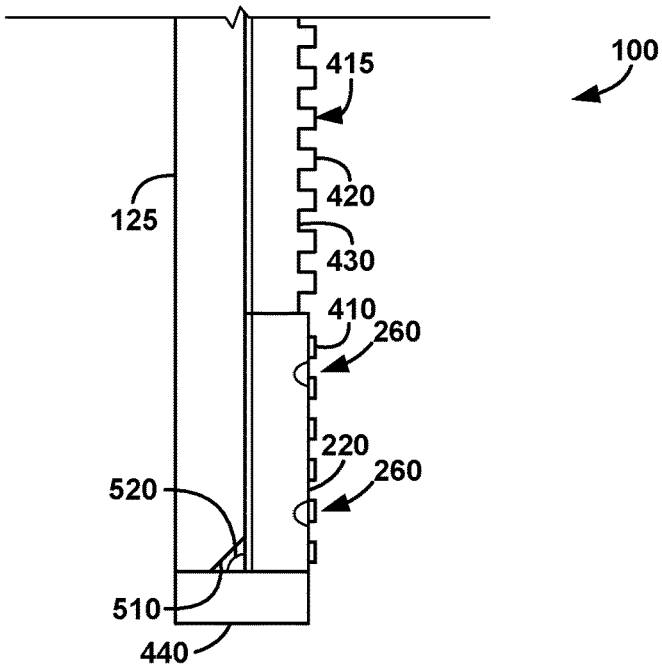
FIG. 4 shows an end view of the replaceable load clamping-plate assembly of load clamping plate wear system according to a preferred embodiment of FIG. 3B.
Figure 5:
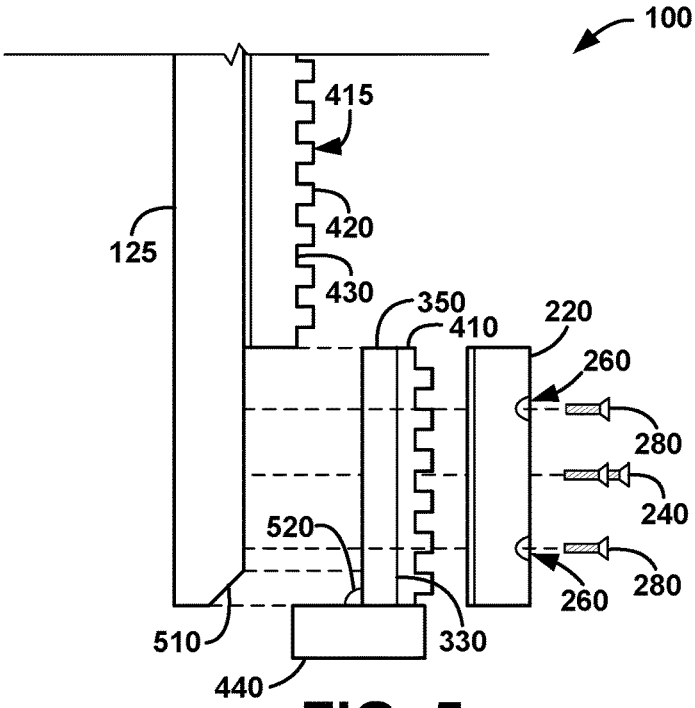
FIG. 5 shows an exploded end view of the replaceable load clamping-plate assembly of load clamping plate-wear system according to a preferred embodiment of FIG. 4.

FIG. 4 shows an end view of the replaceable load clamping-plate assembly 140 of load clamping plate wear system 100 according to a preferred embodiment of FIG. 3. FIG. 5 shows an exploded end view of the replaceable load clamping-plate assembly 140 of load clamping plate-wear system 100 according to a preferred embodiment of FIG. 4.

Inner face 210 of load clamping auxiliary wear-plate assembly 140 preferably comprises an auxiliary pad 410, preferably used to augment the frictional forces developed during contact with load, as shown. The channels or grooves 430 are preferably located between upper surfaces of raised portions 420, as shown. Consequently, when pressure is applied through a squeezing action of the movement of clamping-plates assemblies 120 toward one another to engage a load, the yieldable friction material of auxiliary pad 410 is compressed and is permitted to expand into the area of grooves 430. This permits substantial resiliency; and once the load is released, yieldable friction material of auxiliary pad 410 is configured to rebound to the original configuration. Upon reading the teachings of this specification, those skilled in the art will now appreciate that, under appropriate circumstances, considering such issues as cost, user preference, etc., other resilient surface arrangements, such as, for example, circular depressions or cylindrical columns, etc., may suffice. The preferred vertical thickness of auxiliary pad 410 is selected to be even with clamping pad 415, as shown.

Attachment of load clamping auxiliary wear-plate assembly 140 assembly, and the attached nose piece 220 to clamping-plate assembly 120, is preferably effected first by cutting away an 8 inch width of clamping pad 415 from the lower longitudinal edge of clamping plate assembly 120, leaving the metal plate exposed. Often this cutting away of clamping pad 415 follows the initial wearing of clamping pad 415 at the high-wear area along the lower edge, as opposed to the complete replacement of clamping-plate assembly 120, which ordinarily results from such wear. Load clamping auxiliary wear-plate assembly 140 with nose piece 220 attached is then aligned onto clamping plate assembly 120 with the yieldable friction material on the inner face abutting the yieldable friction material of clamping plate assembly 120, as shown (at least herein embodying wherein said at least one contact plate and said at least one replaceable shoe together substantially covers the at least one face-portion of the at least one clamping plate). Attachment is then effected through recessed holes 255 by means of threaded fasteners 240, which preferably engage tapped holes 250 (previously drilled and tapped as part of a retrofit process) to firmly hold load clamping auxiliary wear-plate assembly 140 in place on the respective clamping plate assembly 120, as shown. Threaded fasteners 240 preferably comprise flat socket head screws, preferably ¾-10NC flat socket head screws.

It should be noted that threaded fasteners 240 passing through load clamping auxiliary wear-plate assembly 140 preferably do not extend through the exposed surface of load clamping auxiliary wear-plate assembly 140; and the heads of threaded fasteners 240 are preferably maintained below the exposed surface of load clamping auxiliary wear-plate assembly 140, preferably below auxiliary pad 410, as shown.

After usefulness of the load clamping auxiliary wear-plate assembly 140 has been expended, the assemblies may preferably be removed and replaced with new units. Load clamping auxiliary wear-plate assembly 140 preferably comprises a relatively small portion of the overall assembly, thus reducing maintenance costs to a significant degree. If nose piece 220 should become damaged, it is also preferably replaceable by removing threaded fasteners 280, and then preferably reassembling a new nose piece 220 with threaded fasteners 280 in the manner described above.

The preferred embodiment of load clamping plate-wear system 100 preferably further comprises at least one wear-resistant bar 440 (at least embodying herein positioned along substantially the entire at least one first longitudinal edge, at least one wear-guard structured and arranged to guard substantially the entire said at least one first longitudinal edge and the at least one edge-portion against abrasive wear; and at least embodying herein positioned along substantially the entire at least one first longitudinal edge, wear-guard means for protecting substantially the entire said at least one first longitudinal edge and the at least one edge-portion from abrasive wear; and at least embodying herein positioned along substantially the entire lower edge of said at least one contact plate, at least one wear-guard bar structured and arranged to guard substantially the entire said lower edge against abrasive wear) attached to the lower edge of load clamping auxiliary wear-plate assembly 140 (at least herein embodying wherein said at least one wear-guard comprises at least one bar underlying said at least one edge-portion of the lower edge of the at least one clamping plate; and at least herein embodying wherein said at least one wear-guard bar substantially covers the at least one edge-portion of the at least one clamping plate) (best illustrated by FIG. 2 and FIG. 3). Wear-resistant bar 440 preferably comprises a metal construction, preferably mild steel, alternately preferably abrasion-resistant (AR) steel, alternately preferably hard-faced steel construction. Wear-resistant bar 440 preferably comprises a solid rectangular rod comprising a width D of about ¼ inch and a height C of about ⅛ inch construction which preferably extends about the full length of load clamping auxiliary wear-plate assembly 140 (at least herein embodying wherein said at least one wear-guard substantially covers the at least one edge-portion of the at least one clamping plate; and at least herein embodying wherein said at least one replaceable wear-bar means substantially covers the at least one edge-portion of the at least one clamping plate).

Wear-resistant bar 440 preferably underlies the at least one clamping plate 125 and the at least one contact plate 350, preferably protecting the lower edge of both clamping plate and contact plate 350 from wear due to contact with objects and floor, as shown. Wear on the underside edge can cause clamping plate to wear into tapped holes 250 and tapped holes 290 rendering clamping-plate assembly 120 in need of replacement. Wear-resistant bar 440 preferably further comprises at least one wear-level marker. A wear-level marker preferably indicates the level of wear at which wear-resistant bar 440 needs replacing to preferably prevent wear to occur on lower edge of clamping plate 125. The wear level marker preferably comprises a line, preferably a color change line. Upon reading the teachings of this specification, those with ordinary skill in the art will now appreciate that, under appropriate circumstances, considering such issues as cost, available materials, etc., other wear-level indicators, such as, for example, depth markings, engravings, depth grooves, etc., may suffice.

Attachment of wear-resistant bar 440 is preferably effected by first by creating a bevel 510 of the lower longitudinal edge of clamping plate 125, as shown. Wear-resistant bar 440 preferably is then welding attached to the lower longitudinal edge of load clamping auxiliary wear-plate assembly 140, preferably using a stitch weld 520. It should be noted that using stitch weld 520 to attach wear-resistant bar 440 to load clamping auxiliary wear-plate assembly 140 allows for the wear-resistant bar 440 to be attached without causing any bowing or other disfiguring of load clamping auxiliary wear-plate assembly 140. Upon reading the teachings of this specification, those skilled in the art will now appreciate that, under appropriate circumstances, considering such issues as cost, time constraints, user preference, etc., other welding techniques, such as, for example, standard bead welding, fusion welding, adhesive welding, etc., may suffice.

Bevel 510 of the lower longitudinal edge of clamping plate 125 creates a groove along the lower longitudinal edge such that when the wear-resistant bar 440 is stitch weld 520 attached, back face 205 of contact plate 350 fits flush against the inner face of the clamping-plate assembly 120 over stitch weld 520. Once the wear-resistant bar 440 is attached to load clamping auxiliary wear-plate assembly 140, the auxiliary wear-plate assemblies can be attached as described above to the clamping-plate assembly 120. The forward end of wear-resistant bar 440 extends slightly forward of the forward end of the load clamping auxiliary wear-plate assembly 140 such that it fits underneath recess 230 at the underside of the nose piece 220, as shown.

The addition of wear-resistant bar 440 to the lower edge of the load clamping-plate assembly 110 provides additional protection against abrasive wear to the lower edge of clamping plate 125, and thus helps to further reduce the need for replacement of the clamping plate assembly, which further reduces costs and downtime of the industrial-type lift trucks.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A wear protection system related to extending the service life of at least one clamping plate of at least one industrial-type lift truck, said system comprising:

a) at least one wear-resistant protector structured and arranged to protect at least one face-portion and at least one edge-portion, while in operation of moving at least one load, of the at least one clamping plate of the at least one industrial-type lift truck;

b) wherein said at least one wear-resistant protector comprises i) at least one first longitudinal edge, at least one second longitudinal edge, and at least one forward edge extending therebetween, ii) at least one removable retainer structured and arranged to removably retain said at least one wear-resistant protector in at least one operable position adjacent said at least one clamping plate, iii) positioned along substantially the entire at least one forward edge, at least one replaceable wear member structured and arranged to protect substantially the entire said at least one forward edge from abrasive wear, and iv) positioned along substantially the entire at least one first longitudinal edge, at least one wear-guard structured and arranged to guard substantially the entire said at least one first longitudinal edge and the at least one edge-portion against abrasive wear;

c) wherein said at least one replaceable wear member comprises at least one removable fastener structured and arranged to removably fasten said at least one replaceable wear member to said at least one wear-resistant protector; and d) wherein said at least one wear-guard substantially covers the at least one edge-portion of the at least one clamping plate;

e) wherein said at least one wear-guard extends vertically away from said at least one first longitudinal edge and the at least one edge-portion of the at least one clamping plate where the at least one clamping plate clamps onto a load horizontally.

2. The wear protection system according to claim 1 wherein said at least one wear-guard comprises at least one bar underlying said at least one edge-portion on the lower edge of the at least one clamping plate.

3. The wear protection system according to claim 1 wherein:

a) said at least one wear-resistant protector further comprises at least one contact plate structured and arranged to contact at least one portion of at least one load during transport by the at least one industrial-type lift truck;

b) wherein said at least one contact plate extends substantially between said at least one first longitudinal edge, said at least one second longitudinal edge, said at least one forward edge, and at least one rear edge of said at least one wear-resistant protector; and c) wherein the at least one operable position of said at least one wear-resistant protector places said at least one contact plate in a position substantially between the at least one clamping plate and the at least one load.

4. The wear protection system according to claim 3 wherein said at least one contact plate comprises at least one friction augmenter structured and arranged to augment the frictional forces developed during contact with the at least one load.

5. The wear protection system according to claim 4 wherein said at least one friction augmenter comprises at least one resilient compressible material.

6. The wear protection system according to claim 5 wherein:

a) said at least one resilient compressible material comprises at least one rubber-like material; and b) said at least one resilient compressible material covers substantially the entire said at least one contact plate.

7. The wear protection system according to claim 5 wherein said at least one resilient compressible material is bonded to said at least one contact plate.

8. The wear protection system according to claim 5 wherein said at least one resilient compressible material comprises a plurality of substantially parallel surface grooves.

9. The wear protection system according to claim 4 wherein said at least one contact plate substantially comprises at least one metallic composition.

10. The wear protection system according to claim 9 wherein said at least one contact plate substantially comprises aluminum.

11. The wear protection system according to claim 4 wherein said at least one replaceable wear member substantially comprises at least one metallic composition.

12. The wear protection system according to claim 11 wherein said at least one replaceable wear member comprises substantially steel.

13. The wear protection system according to claim 1 wherein said at least one removeable retainer comprises at least one plurality of threaded fasteners structured and arranged to mechanically engage the at least one clamping plate.

14. The wear protection system according to claim 13 wherein said at least one threaded fastener is structured and arranged to mechanically engage at least one pre-existing recessed hole in the at least one clamping plate.

15. The wear protection system according to claim 14 wherein said plurality of fasteners comprise countersunk bolts having exposed heads thereof structured and arranged to be situated below the respective exposed surfaces of said at least one contact plate and said at least one replaceable wear member.

16. A wear protection system related to extending the service life of at least one clamping plate of at least one industrial-type lift truck, said system comprising:

a) wear-resistant protector means for protecting at least one face-portion and at least one edge-portion, while in operation of moving at least one load, of the at least one clamping plate of the at least one industrial-type lift truck;

b) wherein said wear-resistant protector means comprises i) at least one first longitudinal edge, at least one second longitudinal edge, and at least one forward edge extending therebetween, ii) removable retainer means for removably retaining said wear-resistant protector means in at least one operable position adjacent said at least one clamping plate, iii) positioned along substantially the entire at least one forward edge, replaceable wear member means for protecting substantially the entire said at least one forward edge from abrasive wear, and iv) positioned along substantially the entire at least one first longitudinal edge, wear-guard means for protecting substantially the entire said at least one first longitudinal edge and the at least one edge-portion from abrasive wear;

c) wherein said replaceable wear member means comprises removable fastener means for removably fastening said replaceable wear member means to said wear-resistant protector means; and d) wherein said wear-guard means substantially covers the at least one edge-portion of the at least one clamping plate;

e) wherein said wear-guard means extends vertically away from said first longitudinal edge and the edge-portion of the clamping plate where the clamping plate clamps onto a load horizontally.

17. The wear protection system according to claim 16 wherein:

a) said wear-resistant protector means further comprises contact means for contacting at least one portion of at least one load during transport by the at least one industrial-type lift truck;

b) wherein said contact means extends substantially between said at least one first longitudinal edge, said at least one second longitudinal edge, said at least one forward edge, and at least one rear edge of said wear-resistant protector means; and c) wherein the at least one operable position of said wear-resistant protector means places said contact means in a position substantially between the at least one clamping plate and the at least one load.

18. The wear protection system according to claim 17 wherein said contact means comprises friction augmenter means for augmenting the frictional forces developed during contact with the at least one load.

19. The wear protection system according to claim 18 wherein said friction augmenter means comprises at least one resilient compressible material.

20. The wear protection system according to claim 19 wherein said at least one resilient compressible material covers substantially the entire said contact means.

21. A wear protection system related to extending the service life of at least one clamping plate of at least one industrial-type lift truck, said system comprising:

a) at least one wear-resistant protector structured and arranged to protect at least one face-portion and at least one edge-portion, while in operation of moving at least one load, of the at least one clamping plate of the at least one industrial-type lift truck;

b) wherein said at least one wear-resistant protector comprises i) at least one contact plate structured and arranged to contact at least one portion of at least one load during transport by the at least one industrial-type lift truck, ii) wherein said at least one contact plate comprises at least one friction augmenter structured and arranged to augment the frictional forces developed during contact with the at least one load, iii) at least one removable retainer structured and arranged to removably retain said at least one wear-resistant protector in at least one operable position adjacent the at least one clamping plate, iv) positioned along substantially the entire at least one forward edge of said at least one contact plate, at least one replaceable shoe structured and arranged to protect substantially the entire said at least one forward edge from abrasive wear, and v) positioned along substantially the entire lower edge of said at least one contact plate, at least one wear-guard bar structured and arranged to guard substantially the entire said lower edge against abrasive wear; and c) wherein said at least one replaceable shoe comprises at least one removable fastener structured and arranged to removably fasten said at least one replaceable shoe to the at least one clamping plate;

d) wherein said at least one wear-guard bar substantially covers the at least one edge-portion of the at least one clamping plate;

e) wherein said at least one contact plate and said at least one replaceable shoe together extend the width of the lower portion of the at least one clamping plate; and f) wherein said at least one contact plate and said at least one replaceable shoe together substantially covers the at least one face-portion of the at least one clamping plate;

g) wherein said at least one wear-guard bar extends vertically away from said lower edge and said at least one edge-portion of the at least one clamping plate where the at least one clamping plate clamps onto a load horizontally.

* * * * *